United States Patent [19]

Frost et al.

[11] 4,381,815

[45] May 3, 1983

[54] THERMAL SHOCK RESISTANT HONEYCOMB STRUCTURES

[75] Inventors: Rodney I. Frost, Corning; Robert D. McBrayer, Painted Post; Vimal K. Pujari, Corning, all of N.Y.

[73] Assignee: Corning Glass Works, Corning, N.Y.

[21] Appl. No.: 205,777

[22] Filed: Nov. 10, 1980

[51] Int. Cl.[3] ..... F28D 19/00; B32B 3/12

[52] U.S. Cl. ..... 165/10; 156/60; 156/304.1; 428/116; 428/118; 428/188

[58] Field of Search ..... 428/116, 188, 118; 165/10; 156/60, 304.1

[56] References Cited

U.S. PATENT DOCUMENTS 4,256,172 3/1981 Rahnbe ..... 165/10 X

FOREIGN PATENT DOCUMENTS 2022071 12/1979 United Kingdom ..... 165/10

2031571 4/1980 United Kingdom ..... 165/10

*Primary Examiner*—Albert W. Davis, Jr.

*Attorney, Agent, or Firm*—Richard N. Wardell

[57] ABSTRACT

The resistance of a honeycombed structure to damage from asymmetric thermal shock occurring across its surface during use and formed with cells having anisotropic Young's moduli in the planes perpendicular the central longitudinal axis of each cell can be improved by varying the orientation of the anisotropic cells with respect to one another so as to minimize the number of such cells being oriented with an axis of maximum Young's moduli aligned with the direction of either the maximum temperature difference or maximum localized temperature gradient occurring across the cell. Improved heat recovery wheels can be formed by bonding together extruded cellular segments, most or all of which contain uniformly oriented, anisotropic square cells and by selecting and arranging the segments so that square cells are uniformly oriented with respect to one another in all segments across the face of the wheel except in those segments which are crossed by or adjacent to the two perpendicularly opposed diameters of the wheel which are paralleled to the sidewalls of the aforesaid, uniformly oriented square cells. In the latter subset of segments, the square cells are uniformly arranged with their diagonals parallel to the aforesaid perpendicularly opposed diameters. Certain exceptions are allowed for selecting the geometric form and orientation of the cells in the cellular segments at the very center of the wheel.

17 Claims, 4 Drawing Figures

THERMAL SHOCK RESISTANT HONEYCOMB STRUCTURES

BACKGROUND OF THE INVENTION

This invention relates to honeycomb structures having improved resistance to damage from asymmetric thermal shock, the cells of which have anisotropic Young's moduli in planes perpendicular to their central longitudinal axes (hereinafter referred to as "cross-sectional planes"), and in particular to improved designs for heat recovery wheels using square, anisotropic cells.

Thin-walled cellular or honeycombed structures are desirable for many uses and in particular for uses involving the flow of hot gases therethrough, such as catalytic reactors and heat recovery wheels [also known as rotary heat exchangers]. Such structures consist primarily or entirely of a honeycomb matrix formed from a plurality of hollow, open-ended cells, the central longitudinal axes of which are generally aligned parallel to one another so as to permit the passage of gases in a uniform direction through the structure. These structures are operated under severe thermal shock conditions and are generally fabricated of ceramic or glass-ceramic materials having very low coefficients of thermal expansion so as to minimize thermal shock damage. Other materials, such as glass, cermet or other ceramic based materials could conceivably be employed if they have sufficiently compatible properties [e.g., strength, chemical resistance, refractoriness, abrasion resistance, etc.] for the particular service conditions involved.

Matrices of hollow, open-ended cells can be produced by the processes of "wrapping" (building up of corrugated layers) or extrustion. The larger size heat recovery wheels needed for efficient industrial heat recovery uses [typically two feet (61 cm) or more in diameter] have been formed previously by cementing together smaller matrices or cellular segments made by the wrap process. Because of the severe thermal conditions encountered in use [typically, instantaneous exposure to gases at temperatures as high as 1500° Fahrenheit (about 820° Centigrade), cyclic asymmetric heating at approximately 20 cycles per minute, 10,000 hours operation] these wheels were formed from material having very low coefficients of thermal expansion, generally on the order of $10\times10^{-7}$/°centigrade or less over the range 0° to 1,000° centigrade, so as to resist damage. Wheels constructed by these prior methods with materials having greater coefficients of thermal expansion (for example, approximately $20\times10^{-7}$/°centigrade or more over the range 0°-1,000° centigrade) have inevitably failed when operated under these conditions.

It is known that the thermal shock resistance of a honeycomb structure can be improved by such techniques as forming cells having movable expansion joints, as is disclosed, for example, in U.S. Pat. Nos. 4,135,018 and 4,127,691, and by providing discontinuities through the cell structure, as is disclosed in U.S. Pat. No. 3,983,283. It has been found that such cellular designs are relatively fragile and often difficult and expensive to fabricate successfully.

Matrices of cells formed by parallel, intersecting planes of material which extend across the matrix to form several adjoining cells are generally stronger and easier to successfully fabricate than the aforesaid flexible cellular designs. The use of uniformly oriented square cells or alternately oriented equilateral triangular cells of identical size to form a honeycomb structure is well known, especially in the area of extruded catalytic reactors. However, the inventors have found that heat recovery wheels made from bonded cellular segments frabricated in such fashion have failed when subjected to the aforesaid typical operating conditions.

As used herein, "temperature gradient" refers to the instantaneous temperature change occurring in a direction through a material, or, in other words, the differential of the temperature distribution curve through the material with respect to a given direction. The "direction" of the temperature gradient is the direction in which the gradient is measured, or, in other words, the direction with respect to which the differential is taken. Also as used in the application, "temperature difference" with respect to a point on a structure refers to the difference between the maximum and the minimum temperatures occurring at any given time along an axis passing through the point and across the surface of the structure. The direction associated with the temperature difference is the direction of the axis along which it was determined.

The terms "cross-section" and "cross-sectional plane" as used herein in referring to a cell refer to a view and plane, respectively, which are perpendicular to the central longitudinal axis of the cell.

SUMMARY OF THE INVENTION

The inventors have found that heat recovery wheels formed from cellular segments and having square cells with their cross-sections uniformly aligned in a single orientation entirely across their honeycombed matrix faces were less severely damaged than were the triangular celled wheels, and that the failures in the square celled wheels occurred primarily along radii of the wheel parallel to the direction of the sidewalls of the square cells.

It is well known that cells with square cross-sectional geometries have anisotropic Young's moduli in their cross-sectional planes, the moduli being a maximum in the cross-sectional plane in directions parallel to the sides forming the square and a minimum in that plane in directions parallel to the diagonals of the square. These maximum and minimum Young's moduli generally differ in magnitude by one or more factors, the exact difference depending upon several conditions including the material selected, the proximity of the cell geometry to a true square, and the thickness of the cellular walls. As hereinafter used, "anisotropic" Young's moduli refer to a maximum Young's modulus value at least one and one-half times that of a minimum modulus value in a cross-sectional plane and "anisotropic cell" refers to a cell having such anisotropic Young's moduli in its cross-sectional planes. "Maximum" or "minimum" Young's modulus when hereinafter used refers respectively to the maximum or minimum Young's modulus measured in a cross-sectional plane of an anisotropic cell. It is intended that cells having near but not true square cross-sections and any other cell having significantly differing Young's moduli in its cross-sectional plane be included among such "anisotropic" cells.

The inventors have determined by analysis and verified in testing centrally supported heat recovery wheels of the type hereinafter described, that the maximum temperature differences and maximum temperature gradients occurring in planes perpendicular to the central rotational axis of such wheels (radial planes) are radially oriented for substantially all cells in the wheel's matrix, and that the temperature gradients with the greatest magnitude are located in the central region of the wheel between that portion of the wheel always covered by seal columns and the immediately adjoining outer portion of the matrix subject to heating by direct impingment of the hot gases.

As thermally induced stress is directly related to a number of factors including the magnitudes of the Young's modulus, of the temperature difference and of the localized temperature gradient in the direction of the stress, the inventors believe that the failures observed in the prior, square celled wheels arose from the coincidence of radially oriented maximum temperature differences and gradients with the maximum Young's moduli of the square cells along those wheel radii parallel to the uniformly aligned square cell walls. The inventors' invention overcomes this problem with the prior square celled wheels.

It is an object of this invention to provide a honeycomb structure having increased resistance to damage from asymmetric thermal heating occurring across its open honeycomb surfaces.

According to the invention this and other objects are accomplished in a honeycomb structure formed from hollow, open ended anisotropic cells, such as square cells, by varying the orientation of the cross-sections of the cells with respect to one another so as to minimize the number of cells oriented with their direction of maximum Young's moduli parallel with the direction of either the maximum temperature difference or maximum temperature gradient occurring across a cross-sectional plane of the cell at the structure's honeycombed surface.

It is a further object of this invention to provide heat recovery wheels with improved thermal shock resistance.

It is also an object of this invention to provide heat recovery wheels made from materials having coefficients of thermal expansion greater than $10\times10^{-7}$/°centigrade over the range 0°-1,000° centigrade and to be used with gases reaching temperatures of approximately 820° centigrade or more.

It is a further object of this invention to provide improved heat recovery wheels made from extruded cellular segments.

It is a further object of this invention to provide heat recovery wheels having improved resistance to damage from $NaNO_3$ and $H_2SO_4$.

According to the invention, these and other objects can be accomplished by forming a heat recovery wheel matrix from a plurality of cellular segments, preferably extruded from a cordierite material having approximately 2.45% manganese oxide by weight being subtituted for a comparable amount of magnesium oxide and bonded to one another, most or all of which have a plurality of anisotropic cells extending through them. The cross-sectional geometries of the ansotropic cells in each segment are substantially uniformly oriented with respect to one another, but the orientation of the cross-sectional geometries of the anisotropic cells in different segments are varied with respect to one another in the resulting wheel so as to prevent all the cells from being uniformly oriented to one another as in the prior art wheels and, more significantly, to minimize the number of such cells along any radius of the wheel oriented with its direction of maximum Young's moduli essentially parallel with the radius. If square cells are used, this is accomplished by minimizing the number of square cells oriented with their sidewalls essentially parallel to radii intersecting them.

In a first embodiment of the invention, a heat recovery wheel is formed with a cylindrically shaped central hub of solid material and a surrounding honeycomb, annular matrix. The matrix is formed from a plurality of extruded cellular segments. Except where shaped to form a portion of the inner or outer circumference of the matrix, the cellular segments are uniformly shaped and have a pair of opposing rectangular honeycomb faces the lengths of which are approximately twice their widths. The segments are joined to one another and to the hub along their outer sidewalls with their honeycombed faces forming the annular faces of the matrix. The cellular segments are arranged according to a pattern of concentric squares. The innermost square is located at the center of the wheel and is formed by the equivalent of two of the rectangularly shaped segments joined along sidewalls forming the long dimension of their rectangular honeycombed faces. The term equivalent is used because the segments forming this innermost concentric square are cored to accept the central hub and so do not have full rectangular honeycombed faces. The joints formed between cellular segments in each concentric square are spanned by the longer sidewall of a segment in the next outer concentric square. The cross-sectional geometries of the cells in the two cellular segments forming the innermost concentric square of the first embodiment are equilateral triangles of substantially uniform size and shape, formed by thin webs of material extending completely through and across each cellular segment. The cross-sectional geometries of the cells in each of the remaining cellular segments are uniformly sized and oriented squares. The sidewalls of the square cells are also formed by webs of material extending completely through and across each segment. The cellular segments are formed so that the webs are arranged essentially parallel to the sidewalls forming peripheries of the rectangular honeycombed faces of the segments (those meeting at right angles) in all of the remaining cellular segments of the wheel except in those crossed by or adjacent to the two (first and second) perpendicular diameters of the wheel parallel to the right angle edges of the rectangular honeycombed faces. In the latter segments the square cells are oriented with their diagonals essentially parallel to, and sides at approximately 45° angles to the aforesaid diameters and right angle edges of the honeycombed faces of the segments. This pattern is repeated until a wheel of sufficient diameter is formed.

In a second embodiment of the invention, a larger diameter heat recovery wheel is formed in the same manner as previously described, except that the central hub is increased in size so as to better support the greater stresses present at the center of the larger wheel, and square celled cellular segments are substituted for the triangular celled segments forming the innermost concentric square at the center of the wheel. These square cells have their diagonals oriented parallel to, and their sides oriented at approximately 45° angles to the aforesaid perpendicular diameters of the wheel and right angle edges of the cellular segments.

A third embodiment of the invention is a third heat recovery wheel identical to the second except that the segments forming the innermost concentric square have square cells the sides of which are oriented parallel to the aforesaid perpendicular diameters of the wheel and right angle edges of the cellular segments.

DETAILED DESCRIPTION OF THE INVENTION

Figure 1:
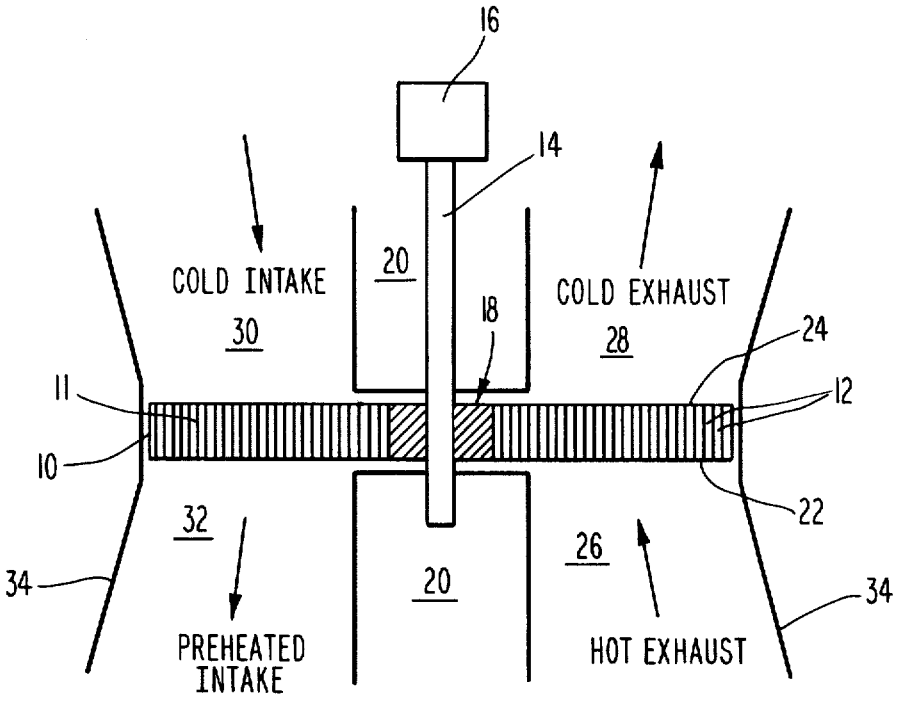
FIG. 1 is a partially sectioned schematic of a counterflow heat exchanger system which would mount a heat recovery wheel of the preferred embodiments.

FIG. 1 depicts a typical counterflow heat exchanger system using a heat recovery wheel 10 made in accordance with the teachings of this invention. The wheel 10 has been cross-sectioned in FIG. 1 to expose a cylindrically shaped solid central hub 18 and an annular matrix 11 formed from a plurality of open-ended, hollow cells 12 each formed by thin intersecting webs of material running axially through the thickness of the wheel 10 from a first annular face 22 to a second annular face 24 of the wheel 10. Typically a ceramic or glass-ceramic material having a very low coefficient of thermal expansion is used to form the matrix 11 and hub 18 although other materials such as glass, cermet or other ceramic base materials could be used if suitable (e.g. sufficiently strong, chemical resistant, etc.) for the service conditions encountered.

A shaft assembly 14 of steel or similar material is typically provided to support and rotate the wheel 10. The shaft assembly 14 passes through the central axis of the wheel 10 and is rotated at a constant rate by a motor 16. The mechanical linkages between the shaft assembly 14 and motor 16 and shaft assembly 14 and wheel 10 have been omitted from the figure. The hub 18 is provided integrally at the center of the wheel 10 to insulate the shaft assembly 14 from overheating and to support the greater mechanical stresses present there in the wheel.

The function of the depicted system is to transfer thermal energy between gases having differing temperatures flowing through opposite halves of the wheel 10. Seal columns 20 are positioned juxtaposed the annular faces 22 and 24 and extend away from them to separate the counterflowing hot and cold gases. Outer walls 34 surround the wheel 10 and seal columns 20 forming chambers 26, 28, 30 and 32 on either side of the wheel 10. The first chamber 26 funnels hot gas to the first annular face 22 of the wheel 10. In typical applications, the hot gas is a combustion exhaust and is forced by suitable means (not depicted) such as gravity, convection, a pump or fan, to flow through the cells 12 giving up its heat to the cellular walls in the process. The then cooled exhaust gas passes through the second annular face 24 of the wheel 10 into a second chamber 28 which in turn leads to a suitable means of disposal (not depicted). In time, the portion of the wheel 10 to the right of the shaft 14 (as viewed in FIG. 1), having been warmed by the hot exhaust gas, is rotated by the shaft 14 and motor 16 to the left side of the hub 18 and is exposed to a cold gas being channeled into a third chamber 30. Typically this cold intake gas is air to be preheated for combustion, and is forced by appropriate means (again not depicted) through the second annular face 24, cells 12 and first annular face 22 of the wheel 10 into a fourth chamber 32. In the process the cold intake gas absorbs the heat being held in the walls of the cells 12 on the left side of the wheel 10 (as viewed in FIG. 1). The now warmed intake gas in the fourth chamber 32 is conducted away from the wheel 10 by suitable means (not depicted) for use. Running the hot exhaust and cold intake gases in opposite directions through the wheel 10 results in "hot" and "cold" faces (the first annular face 22 and second annular face 24, respectively, in the system depicted in FIG. 1), the former operating at a higher average temperature than the latter. It also results in asymmetric heating of the wheel, the matrix exposed to the hot gas flow being heated to almost the temperature of the gases flowing through it, while the matrix under the seal column and on the opposite half of the wheel exposed to the cooler gas flow remaining relatively much cooler. This counterflow arrangement does reduce the magnitude of the thermal shock to which the wheel 10 is exposed and so allows potential optimization of the thermal efficiency of the system.

Figure 2:
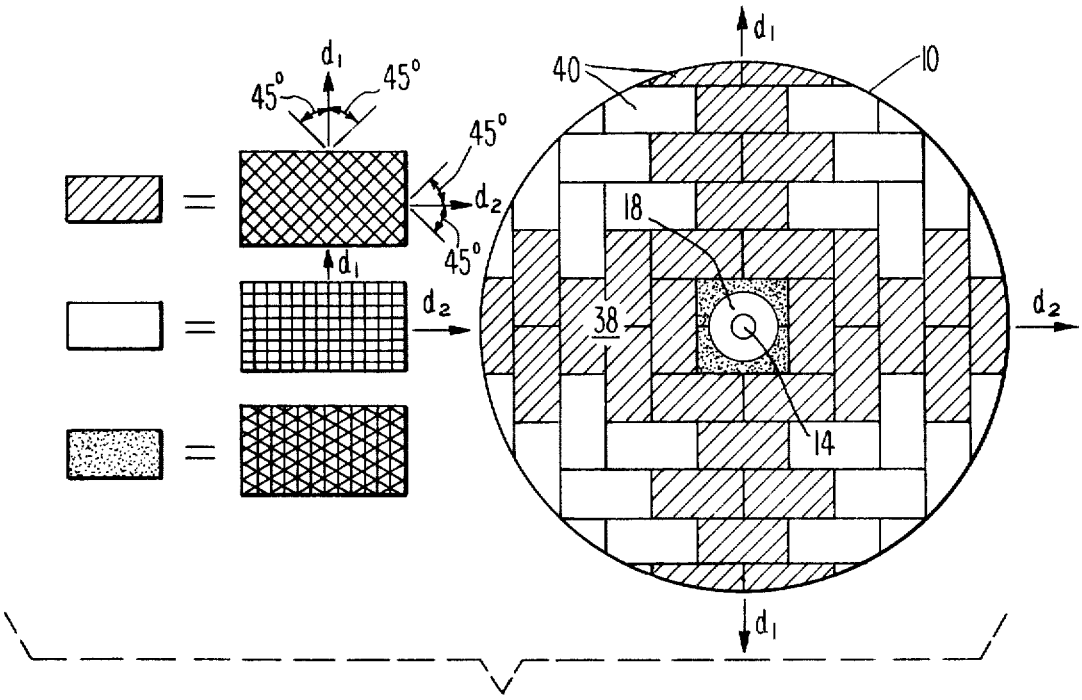
FIG. 2 depicts a first preferred embodiment of the invention, an industrial sized heat recovery wheel.

Referring now to FIG. 2, there is depicted an annular face of a first embodiment heat recovery wheel 10 as is used in the counterflow heat exchanger system depicted in FIG. 1. A cylindrically shaped central hub 18, typically solid, is positioned on a shaft assembly 14, and is surrounded by an annular matrix 38 formed from a plurality of joined cellular segments 40. A plurality of hollow, open ended cells extend between a pair of opposing, honeycombed faces on each cellular segment 40. Side walls form the remaining outer surfaces of each cellular segment 40. The cellular segments 40 are arranged so that a honeycomb face of each forms a portion of the honeycombed surface of the annular matrix 38. It is easiest to form the matrix 38 from a single layer of cellular segments 40 joined to one another along their side walls. An identical annular honeycombed matrix surface is thus formed on the opposite side of the wheel. However, it is contemplated that a satisfactory wheel may also be made by overlaying several layers of cellular segments 40 to form a wheel of appropriate thickness, so long as the central longitudinal axes of the cells are reasonably aligned so that the gases are allowed to flow through the wheel with a minimum of hinderance.

The cellular segments 40 are shaped so as to be capable of being joined along their side walls to form a continuous matrix without significant gaps. With the exception of those which have been shaped to form a portion of the inner or outer circumference of the annular matrix 38, the segments 40 are uniformly sized and shaped and have opposing honeycomb faces which are substantially rectangular having lengths approximately twice their widths. It will be noted in FIG. 2, that each cellular segment 40, including those forming a portion of the inner or outer circumference of the annular matrix 38, has at least two sidewalls meeting at approximately right angles so as to be joined to other segments without forming significant gaps.

Different combinations of cellular cross-sectional geometries and orientations are used in the wheel 10 and are depicted by a key on the left side of FIG. 2. The figures in the left half of the key correspond to the cellular segments in the wheel 10 and are shaded, diagonally lined or unshaded and unlined to represent the three different types of cellular segments used to form the wheel 10. The figures in the right half of the key depict in great magnification the general shape and orientation of the cross-sectional geometries of the cells in each of the three types of cellular segments used. To further assist interpreting the structure and orientation of the cells in these cellular segments, especially the cells having square cross-sectional geometries ("square cells"), first and second, perpendicularly oriented diameters of the wheel 10 are indicated by $d_1$ and $d_2$, respectively, and are similarly depicted on the upper two square celled cellular segments of the key.

As indicated in the key, those cellular segments 40 crossed by diagonal lines contain cells having substantially square, uniformly aligned and oriented cross-sections. The sides of these square cells are oriented at approximately 45 degree angles to the side walls of the cellular segments meeting at right angles and, when positioned on the wheels, to the diameters $d_1$ and $d_2$. The unshaded cellular segments 40 in the wheel 10 represent segments having square cells, the sides of which are substantially parallel to the sidewalls of the segments meeting at right angles and, when positioned in the wheel 10, to the diameters $d_1$ and $d_2$. Lastly, the two shaded cellular segments 40 at the very center of the wheel 10 have cells with essentially uniform, equilateral triangular, cross-sectional geometries.

As can be appreciated from examining the key, the diagonals of the cross-sections of cells in each square celled segment and thus the directions of the minimum Young's modulus of these cells are uniformly oriented in two directions. Similarly the sides forming the square cross-sections of those cells and thus their directions of maximum Young's modulus are also oriented in two directions different from one another and from the directions of the minimum Young's modulus. It is envisioned that if cells not truly square in form or other anisotropic cells are used, there will only be a single orientation of maximum and single and different orientation of minimum Young's moduli for each cell. However, if the cross-sections of these cells are uniformly oriented with respect to one another, as are the square cells depicted, that is to say the corresponding parts of their cross-sectional geometries are oriented at approximately the same angular relationship to some external reference like the sides of the cellular segment, the directions of maximum and minimum Young's moduli of these cells will also all be uniformly oriented in two different directions.

As can also be seen from the key, the cross-sectional geometry of the cells in each cellular segment 40, when viewed along planes perpendicular to their central longitudinal axes, are substantially identical in size as well as shape. The square cells are themselves formed by two sets of substantially parallel planes intersecting each other at approximately right angles. Projections of these intersecting planes are depicted in the key. As can be seen, these planes and thus the sides of the square cells in the diagonally lined cellular segments are oriented at approximately 45° angles to the diameters $d_1$ and $d_2$, when mounted in the wheel 10.

The cellular segments 40 are joined to one another and to the central hub by any means suitable, typically cementing. Preferred methods of cementing cellular segments to one another so as to form a heat recovery wheel with improved thermal shock resistance are disclosed in co-pending applications Ser. No. 205,775 filed Nov. 10, 1982 (now U.S. Pat. No. 4,335,783) and Ser. No. 205,776 filed Nov. 10, 1982 (now U.S. Pat. No. 4,333,518), which suggest applying the cement so as to form discontinuities extending axially through the wheel in a direction approximately parallel with the central longitudinal axes of the cells and recessing the cement approximately ½ inch (1.3 cm) from the resulting hot, annular face of the wheel 10 (the first annular face 22 of the wheel depicted in the system in FIG. 1), respectively. These copending applications are hereby incorporated by reference.

The segments 40 are arranged in a series of concentric squares, the two, equilateral triangle celled segments forming the innermost square. Joints formed between segments 40 of each concentric square are spanned by the length of a longer sidewall of a segment 40 in the next outermost concentric square. The unshaded cellular segments (containing square cells with sides substantially parallel to sidewalls of the cellular segments meeting at right angles) are used in forming the successive concentric squares except where a segment is crossed by or adjoins one of the two perpendicular diameters $d_1$ and $d_2$ of the wheel, which are themselves substantially parallel to the sidewalls of the segments 40 meeting at right angles and thus to the sidewalls of the square cells in the unshaded segments 40. There the diagonally arranged square celled segments 40 (represented in the wheel 10 by the diagonally lined cellular segments 40) are used.

The intent of the arrangement of cellular segments 40 depicted in FIG. 2 is to minimize the number of square cells having their sidewalls, and thus their maximum Young's moduli, essentially parallel to the radii of the wheel 10 passing through each such cell. The radii passing through each cell defines the direction of maximum temperature difference and temperature gradient occurring across the cross-sectional plane of the cell at the annular face of the wheel 10. It is impossible to orient all square cells so that their sidewalls are not coincident with such an intersecting radii when using a central hub 18 and rectangular cellular segments 40 of the relative sizes indicated in FIG. 2. However, the arrangement of the cellular segments 40 depicted in FIG. 2 minimizes the number of square cells so oriented. It further prevents there being any substantial alignment of maximum Young's moduli of cells along any given radius which would give rise to the damaging stresses suffered by the prior art wheels previously referred to.

Figure 3:
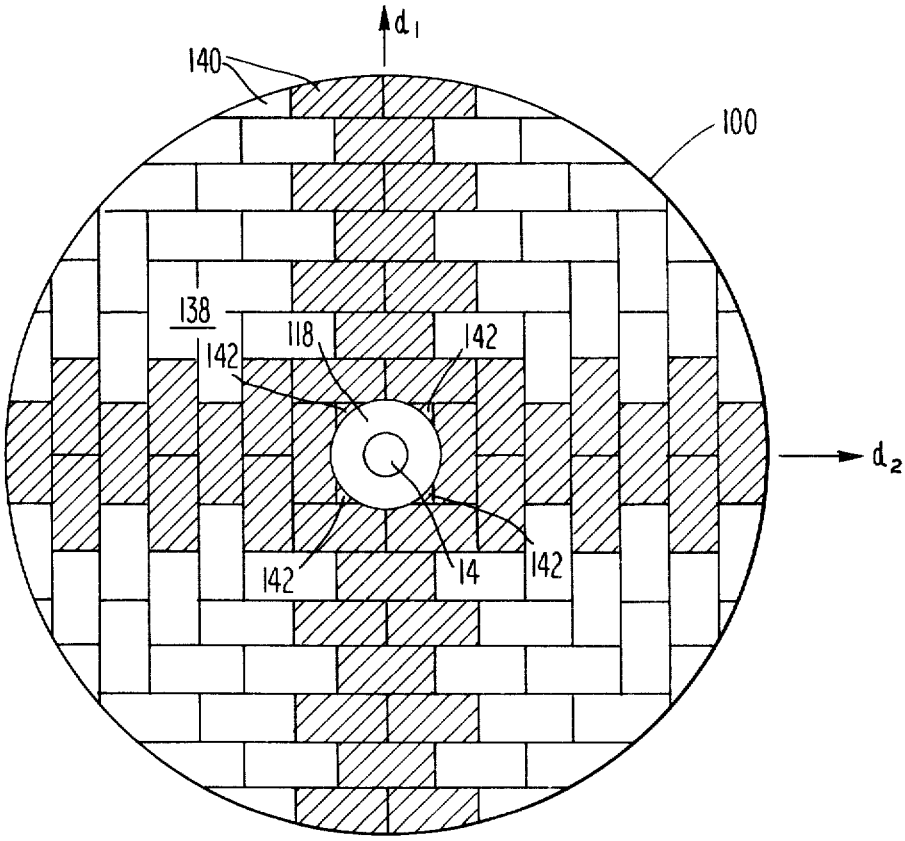
FIG. 3 depicts a second embodiment of the invention, a somewhat larger industrial sized heat recovery wheel.

Turning now to FIG. 3, there is depicted a second embodiment of the invention, a second heat recovery wheel 100 somewhat larger than the wheel 10 depicted in FIG. 2. As in the case of the first embodiment depicted in FIG. 2, the wheel 100 in FIG. 3 comprises a cylindrically shaped central hub 118, typically solid, surrounded by an annular matrix 138 formed by a plurality of joined cellular segments 140 and 142. The wheel is positioned on a shaft assembly 14 passing through the center of the central hub 118. The cellular segments 140 and 142 of the wheel 100 depicted in FIG. 3 are in all respects the same as the cellular segments 40 of the wheel 10 depicted in the key in FIG. 2. The cross-sectional geometries and orientations of the cells in the cellular segments 140 and 142 of the wheel 100 are indicated in the same manner as used in FIG. 2. As can be determined by examination, the wheel 100 in FIG. 3 is formed from cellular segments 140 and 142 of only two differing cellular cross-sectional geometry/orientation combinations: square cells having sides oriented substantially parallel with the sidewalls of the cellular segment meeting at right angles and with perpendicularly oriented diameters $d_1$ and $d_2$ of the wheel 100 (represented by unshaded cellular segments 140); and square cells having sides oriented at approximately 45° angles to the sidewalls of cellular segments meeting at right angles and to the diameters $d_1$ and $d_2$ (indicated by diagonally lined cellular segments 140 and 142). The cellular segments 140 and 142 of the wheel 100 in FIG. 3 are again arranged in the same pattern of concentric squares previously described with respect to the first embodiment of the invention depicted in FIG. 2. However, a greater number of cellular segments 140 and 142 are used to form the relatively larger wheel 100. Also, a relatively larger central hub 118 is provided in the wheel 100 depicted in FIG. 3 to support the greater stresses which would be present at the center of a larger wheel.

The wheel 100 depicted in FIG. 3 differs in one more significant respect from that depicted in FIG. 2. Four relatively smaller cellular segments 142 form the innermost concentric square at the center of the wheel 100 and contain cells with square rather than triangular cross-sections. Four relatively small cellular segments 142 must be used to form the inner concentric square because the relatively larger hub 118 of the wheel 100 requires the removal of a greater portion of the center of the matrix than did the hub 18 of the wheel 10 in FIG. 2. The square cells of these four small cellular segments 142 are depicted in FIG. 3 as being diagonally oriented, that is the sides of the individual cells are aligned at approximately 45° angles to sidewalls of the segments which meet at right angles and to the diameters $d_1$ and $d_2$, while their diagonals are substantially parallel to those sidewalls and diameters. As is apparent from an inspection of FIG. 3, with the exception of the four segments 142 at the very center of the wheel, only those cellular segments 140 bisected by or adjoining the two perpendicular diameters $d_1$ and $d_2$ of the wheel 100, which are parallel to the sidewalls of the cellular segments 140 and 142 meeting at right angles, contain the diagonally lined (diagonally oriented square cells) cellular segments. In the remaining cellular segments 140, the walls of the square cells are parallel to the cellular segment sidewalls meeting at right angles and to the aforesaid diameters $d_1$ and $d_2$. As in the case of the wheel 10 of FIG. 2 the outermost cellular segments 140 are also shaped to form the outer circumference of the wheel 100.

Figure 4:
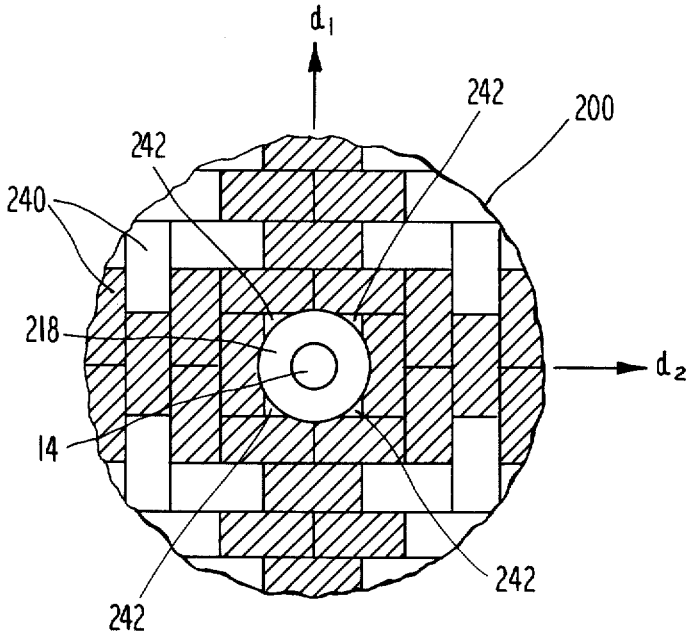
FIG. 4 depicts the center portion of a third embodiment heat recovery wheel.

Lastly, in FIG. 4 there is depicted a portion of a third embodiment, a third heat recovery wheel 200, which, with the exception of the orientation of the square cross-sections of the cells in the four, smaller cellular segments 242 surrounding the central hub 218, is identical in all respects to the wheel 100 of FIG. 3. The four samll cellular segments 242 of the wheel 200 in FIG. 4 contain cells having uniformly aligned square cross-sections the sides of which are, as indicated by the key in FIG. 2, parallel to the perpendicularly oriented diameters $d_1$ and $d_2$. The sidewalls of the cellular segments 240 and 242 meet at right angles.

Wheels similar to those depicted in FIGS. 2 and 3 have been fabricated from a cordierite material of a type in which approximately 2.45% manganese oxide by weight had been substituted for a comparable amount of magnesium oxide to enhance the material's resistance to $NaNO_3$ and $H_2SO_4$ attack. This material is the subject of a copending application Ser. No. 165,611 filed July 3, 1980 (now U.S. Pat. No. 4,300,953) by Irwin M. Lachman, which is incorporated herein by reference. The resulting material has a coefficient of thermal expansion of approximately $18\times10^{-7}$/°Centigrade over the range 0° to 1,000° centigrade. Honeycomb logs of the cordierite material were extruded and fired as described in the aforesaid application. Cells were formed by extruded planar webs of material between about 10 to 12 thousandths of an inch (0.25–0.30 mm) thick which extended entirely across and through each log. The triangular cells were formed at a preferred density of approximately 310 cells per square inch (48 cells/cm$^2$) and the square cells at a preferred density of approximately 250 cells per square inch (39 cells/cm$^2$). Appropriately sized central hubs, [approximately 4 inch (10.2 cm) outer diameter and 1.5 inch (3.8 cm) inner diameter for a 28 inch (71.1 cm) diameter wheel similar to that depicted in FIG. 2, and approximately 6 inch (about 15.2 cm) outer diameter and approximately 3 inch (7.6 cm) inner diameter for a simulated 40 inch (101.6 cm) diameter wheel similar to that depicted in FIG. 3] were also extruded by conventional means from the same material and fired. Once fired, the extruded logs were cut into blocks slightly thicker than the resulting wheel thickness and ground to a uniform rectangular size, approximately 5 inches by 2½ inches (12.7 cm by 6.4 cm). The blocks were then laid out in the arrangement of concentric square patterns previously described. The central cellular segments were cemented together, temporarily bound and bored to accept the central hub which was also cemented into place. The remaining cellular segments were cemented to one another in the concentric squares patterns described above and depicted in FIGS. 2, 3 and 4, according to the methods disclosed in the aforementioned co-pending applications Ser. Nos. 205,775 and 205,776. A glass-ceramic foaming cement in accordance with U.S. Pat. No. 3,634,111 and preferably comprising by weight 4.0% ZnO, 8.0% CaO, 3.4% SiC and 84.6% glass frit of composition 1 set forth in Table I of that patent, which is hereby incorporated by reference, was used. The cement has a coefficient of thermal expansion comparable to that of the cordierite material used in the cellular segments and central hub. After the cement was allowed to dry, the wheels were fired to form and sinter the cement between and to the adjoining wheel parts. The wheel was then ground to final form and size. Twenty-eight inch (about 71 cm) diameter wheels built to the first two described embodiment designs (the outermost cellular segments of the 40 inch (102 cm) wheel design depicted in FIG. 3 were eliminated), were found to have improved thermal shock performance when compared to aforesaid prior art wheels.

The inventors envision that other types of honeycombed structures having improved resistance to damage from asymmetric thermal shock can be fabricated by bonding together extruded cellular segments honeycombed with uniformly oriented anisotropic cells. Orientation of the cells in the resulting structure can be varied by varying the orientation of the cells with respect to the outer sidewalls of the cellular segments as in the forming of the heat recovery wheels described above, or by forming the cellular segments with the cells uniformly oriented with respect to the segment's sidewalls in all segments and rotating the segments with respect to one another when forming the structure. The latter can be accomplished by forming the segments in equilateral geometric forms (triangle, pentangle, etc.).

Although successfully tested densities of cells and cell wall thicknesses have been described, it is envisioned that improved thermal shock performance can be obtained from cells of other densities or wall thicknesses or both using the preferred embodiments described. It is also envisioned that other arrangements of rectangular cellular segments and other arrangements of cellular segments having geometric forms other than rectangular may be used successfully to practice the invention.

The invention has been described with respect to a centrally driven heat recovery wheel, but applicants envision that the matrix of a rim driven rotary heat exchanger can be constructed in the same fashion. In such wheels there are also severe, radially oriented temperature gradients within one to two inches (2.54 to 5.08 cm) of the outer circumference of the wheel where it is shielded to keep the rim driving mechanism at an operating temperature below that of the hot gases typically passed through such a wheel.

Although preferrred embodiments of the invention have been shown and described and various alternatives and modifications have been suggested, it will be understood that the appended claims are intended to cover all embodiments and modifications which fall within the true spirit and scope of the invention.

What is claimed is:

1. A structure subject to asymmetric thermal shock comprising:

a plurality of cellular segments joined to one another, each of said segments having a plurality of hollow, open ended cells extending therethrough, substantially all of said cells in each of said cellular segments having anisotropic Young's moduli in their cross-sectional planes, substantially all of said anisotropic cells in each of said cellular segments having an axis of minimum Young's modulus oriented in the same direction, and said direction of similarily oriented axes of minimum Young's modulus being varied from cellular segment to cellular segment in said structure so as not to be uniformly aligned in the same direction throughout said structure.

2. The structure described in claim 1 having a honeycombed outer surface formed from said cellular segments, said surface having temperature differences and temperature gradient thereacross from said asymmetric thermal shock, wherein said similarily oriented axes of minimum Young's modulus are further oriented in said structure so as to minimize the number of said anisotropic cells having a direction of maximum Young's moduli aligned with the direction of a maximum temperature difference or of a maximum temperature gradient occuring across a cross-sectional plane of the cell at said honeycombed surface.

3. The structure described in claim 1 further comprising a honeycomb matrix of a heat recovery wheel wherein substantially all of said anisotropic cells have the same cross-sectional geometric form, said cross-sectional geometries of said anisotropic cells being uniformly aligned with respect to one another in each cellular segment, said cross-sectional geometries of said anisotropic cells further being uniformly oriented with respect to one another throughout said matrix except in those segments crossed by or adjoining a radius of said wheel parallel to a direction of maximum Young's modulus of said uniformly oriented anisotropic cells wherein said anisotropic cells are uniformly aligned with a direction of their minimum Young's modulus parallel to said adjoining or crossing radius.

4. A method of forming a honeycomb structure subject to asymmetric heating comprising the steps of:

forming a plurality of cellular segments, each of said segments having a plurality of open ended cells extending therethrough, substantially all of said cells in each of said segments having anisotropic Young's moduli in their cross-sectional planes and cross-sectional geometries of the same form and orientation; and joining said cellular segments to one another so that said cross-sectional geometries of said anisotropic cells are arranged in at least two different orientations in said structure.

5. A heat recovery wheel having a first diameter and second diameter perpendicular thereto and formed from a plurality of joined cellular segments comprising:

a first subset of said cellular segments, each of said segments adjoining or crossed by either of said first or second diameters and having a plurality of hollow, open-ended cells with substantially square cross-sectional geometries extending therethrough, the sides forming said substantially square cross-sectional geometries being oriented at approximately 45° angles to said first and second diameters; and a second subset of said cellular segments, each of said cellular segments having a plurality of hollow, open-ended cells with substantially square cross-sectional geometries extending therethrough, the sides forming said substantially square cross-sectional geometries being oriented at acute angles other than approximately 45° or at 90° to either said first or said second diameter.

6. The heat recovery wheel described in claim 5 wherein said hollow, open-ended cells are formed by a plurality of intersecting webs of material which extend in continuous planes completely through and across each cellular segment.

7. The heat recovery wheel described in claim 6 wherein said material comprises a ceramic.

8. The heat recovery wheel described in claim 7 wherein said material has a coefficient of thermal expansion of approximately $18\times10^{-7}$/°centigrade or more over the range 0° to 1,000° centigrade.

9. The heat recovery wheel described in claim 8 wherein said ceramic material further comprises a cordierite containing between 2 and 3 percent manganese oxide by weight.

10. The heat recovery wheel described in claim 5 wherein each of the sides forming the cross-sectional geometries of said square cells in said second subset of cellular segments is oriented substantially parallel to one or the other of said first and second diameters.

11. The heat recovery wheel described in claim 5 further comprising an annular matrix having inner and outer circumferences and formed from said cellular segments wherein, with the exception of those cellular segments which are shaped to form a portion of said inner or outer circumferences, said cellular segments are substantially uniform in size and shape, each of said uniform cellular segments having a pair of opposing rectangularly shaped honeycomb faces and sidewalls forming their remaining outer surfaces, said rectangularly shaped honeycomb faces having lengths approximately twice their widths.

12. The heat recovery wheel described in claim 11 further comprising an arrangement of said cellular segments in a series of concentric squares centered at the center of said wheel, the length of an outer side of the innermost concentric square being equal to the length of a longer sidewall of said uniform cellular segments and each joint between each pair of joined cellular segments in each concentric square being spanned by a longer sidewall of a cellular segment in the next outermost concentric square.

13. The heat recovery wheel described in claim 12 wherein the cells of the cellular segments forming said innermost concentric square have uniform, substantially square cross-sectional geometries, the sides of said square cross-sections being oriented at approximately 45° angles to said first and second diameters, and the remainder of said cellular segments forming said annular matrix belong to either said first or second subset.

14. The heat recovery wheel described in claim 12 wherein the cells of the cellular segments forming said innermost concentric square have uniform, substantially equilateral triangular cross-sectional geometries and the remainder of said cellular segments forming said annular matrix belong to either said first or second subset.

15. The heat recovery wheel described in claim 12 wherein the cells of the cellular segments forming said innermost concentric square have uniform, substantially square cross-sectional geometries, the sides of said square cross-sectional geometries being substantially parallel to either said first or second diameter and the remainder of said cellular segments forming said annular matrix belong to either said first or second subset.

16. The heat recovery wheel described in claim 13, 14 or 15 wherein each of the sides forming said square cross-sections of the cells in said second subset of cellular segments is substantially parallel to either said first or second diameter.

17. The method of claim 4 where said joining includes arranging said segments of one orientation with the direction of minimum Young's modules of said cells in said segments of one orientation being substantially parallel to a radius of said wheel crossing or adjoining said segments of one orientation, and arranging said segments of another orientation with the direction of maximum Young's modulus of said cells in said segment of another orientation being substantially parallel to said crossing or adjoining radius.

* * * * *